US012391455B1

(12) United States Patent
Feuchtwanger, III

(10) Patent No.: US 12,391,455 B1
(45) Date of Patent: Aug. 19, 2025

(54) DEVICE FOR MIXING AND DISPENSING A PERSONALIZED TOOTHPASTE

(71) Applicant: Joseph B. Feuchtwanger, III, South Setauket, NY (US)

(72) Inventor: Joseph B. Feuchtwanger, III, South Setauket, NY (US)

( * ) Notice: Subject to any disclaimer, the term of this patent is extended or adjusted under 35 U.S.C. 154(b) by 0 days.

(21) Appl. No.: 19/091,378

(22) Filed: Mar. 26, 2025

Related U.S. Application Data

(60) Provisional application No. 63/675,546, filed on Jul. 25, 2024.

(51) Int. Cl.
*B65D 81/32* (2006.01)

(52) U.S. Cl.
CPC ..... *B65D 81/325* (2013.01); *B65D 81/3288* (2013.01)

(58) Field of Classification Search
CPC ..... B65D 81/325; B65D 81/3288
See application file for complete search history.

(56) References Cited

U.S. PATENT DOCUMENTS 4,211,341 A * 7/1980 Weyn ..... B65D 35/22 222/94
4,471,888 A * 9/1984 Herb ..... B05C 17/0126 222/391
5,184,757 A * 2/1993 Giannuzzi ..... B05C 17/00506 222/323
5,249,709 A * 10/1993 Duckworth ..... B05C 17/00579 222/137
5,332,122 A * 7/1994 Herold ..... B65D 81/325 222/326
5,332,124 A * 7/1994 Cancro ..... B65D 81/325 222/137
5,667,102 A * 9/1997 Keller ..... B05C 17/00513 222/327
5,701,921 A * 12/1997 Father ..... A46B 15/0055 222/23
6,176,396 B1 * 1/2001 Hamada ..... G01F 11/025 222/137
6,352,177 B1 * 3/2002 Bublewitz ..... B01F 27/0724 222/137
6,732,887 B2 * 5/2004 Bills ..... A61C 5/64 222/137

(Continued)

*Primary Examiner* — Frederick C Nicolas
(74) *Attorney, Agent, or Firm* — BKDowd Law, P.C.; Betsy Kingsbury Dowd, Esq

(57) ABSTRACT

A device for blending and dispensing a personalized toothpaste includes a housing, including a first retaining chamber and a second retaining chamber, configured to load a primary cartridge and a secondary cartridge respectively therein at a predetermined rotational orientation, to align the cartridges in fluid connection with a nozzle through which the toothpaste is dispensed. The primary cartridge contains base components, and the secondary cartridge includes flavorings and colorings selected by a user to personalize the toothpaste. The housing and cartridges include elements allowing the cartridges to be interchangeable. A system also includes a dispenser, which may be a plunger, to move the contents from the cartridges, blend them in the nozzle and extrude the personalized toothpaste therefrom. A kit also includes a plurality of the interchangeable cartridges with different flavorings and colorings.

21 Claims, 7 Drawing Sheets

(56) References Cited

U.S. PATENT DOCUMENTS

| | | | | |
|---|---|---|---|---|
| 8,544,683 | B2 * | 10/2013 | Springhorn | B05C 17/0106 222/137 |
| 9,242,784 | B2 * | 1/2016 | Buck | B05C 17/00583 |
| 9,527,106 | B2 * | 12/2016 | Ngu | B05C 17/00583 |
| 11,040,369 | B2 * | 6/2021 | Dean | B65D 81/3288 |
| 2009/0321477 | A1 * | 12/2009 | Baca | B65D 35/34 222/93 |
| 2012/0104030 | A1 * | 5/2012 | Springhorn | B05C 17/00576 222/137 |
| 2013/0277390 | A1 * | 10/2013 | Buck | B05C 17/00553 222/137 |
| 2014/0117046 | A1 * | 5/2014 | Ettlin | B65D 81/325 222/145.5 |
| 2015/0114986 | A1 * | 4/2015 | Ngu | B05C 17/00583 222/137 |
| 2015/0114995 | A1 * | 4/2015 | DiSiro | B05C 17/01 222/137 |
| 2016/0296963 | A1 * | 10/2016 | Dean | B05C 17/0106 |
| 2019/0142712 | A1 * | 5/2019 | Neill | A61K 8/0245 424/49 |
| 2020/0121586 | A1 * | 4/2020 | Giniger | A61K 8/96 |
| 2020/0297594 | A1 * | 9/2020 | Dogo-Isonagie | A61K 8/22 |

* cited by examiner

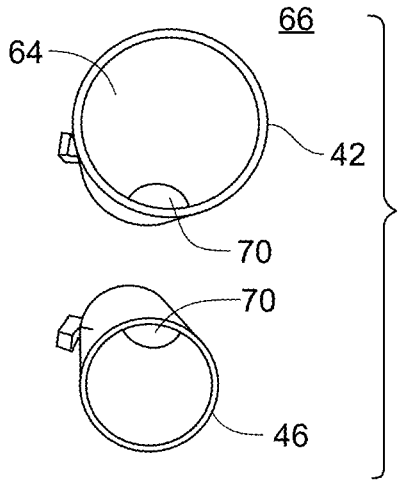
FIG. 2
FIG. 3A
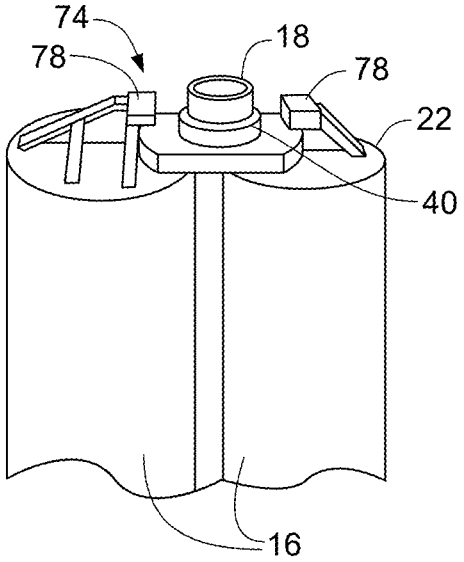
FIG. 3B
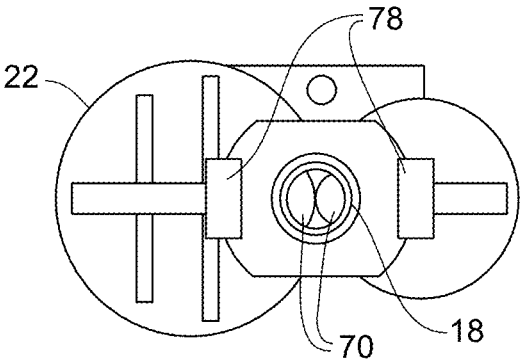

DEVICE FOR MIXING AND DISPENSING A PERSONALIZED TOOTHPASTE

CROSS-REFERENCE TO RELATED APPLICATIONS

This application claims the benefit of and priority to U.S. Provisional Application Ser. No. 63/675,546 entitled "DEVICE FOR MIXING AND DISPENSING A PERSONALIZED TOOTHPASTE," filed Jul. 25, 2024, the entirety of which is hereby incorporated herein by reference thereto.

FIELD OF DISCLOSURE

The present disclosure relates generally to personalizing toothpaste and, in particular, to an at-home device and kit for personalizing toothpaste.

BACKGROUND

There are numerous educational books and videos available to encourage children to brush daily. Children's toothbrushes are also available that are decorated with festive colors, children's themes, or appealing characters. Children's dental kits are even sold in zippered pouches that include floss, toothpaste, and a colored sand "hourglass" configured to time a 2-minute brushing. While these products may initially help to encourage children to brush, the novelty often wears off too quickly to instill long-term daily dental care habits. Notably, none of the options available give the child a choice of toothpaste flavoring or to be otherwise creatively involved in personalizing the taste or color of the toothpaste.

Accordingly, there is a need for a device, system and kit for mixing and dispensing a personalized toothpaste, for example, for taste and color.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a device for mixing or blending a personalized toothpaste, and a system including the device and a dispenser for dispensing the personalized toothpaste.

The present disclosure is also directed to a kit which includes at least any of the embodiments of the device of the present disclosure and a variety of interchangeable cartridges including components, for example, for personalizing taste and color, for forming the personalized toothpaste.

The present disclosure is also directed to methods for forming and dispensing a personalized toothpaste using the device of the present disclosure.

The present disclosure is also directed to a device for blending and dispensing a personalized toothpaste. The device includes a housing including a first end and a second end, and a first retaining chamber and a second retaining chamber parallel to the first retaining chamber and positioned perpendicularly between the first end and the second end. Each of the first retaining chamber and the second retaining chamber is sized and shaped to receive therein and remove therefrom, respectively, a primary cartridge and a secondary cartridge, which are configured to be interchangeable with other primary cartridges and secondary cartridges, respectively, wherein contents of each of the primary cartridge and the secondary cartridge include components of a personalized toothpaste. The device also includes a nozzle extending from the second end of the housing and aligned in fluid connection with both the primary cartridge and the secondary cartridge to receive the components therefrom. The housing is operably connectable with a dispenser that is operable to move the components from each of the primary and the secondary cartridge into, through, and out of the nozzle to dispense the personalized toothpaste in use, such that the personalized toothpaste exiting the nozzle is a blend of the components from the primary cartridge and the secondary cartridge.

The first and the second retaining chamber, in embodiments, each includes an alignment element positioned to receive the primary cartridge and the secondary cartridge, respectively, in a predetermined rotational orientation. Each of the primary cartridge and the secondary cartridge also includes a mating alignment element that cooperates with the alignment element to seat each of the primary cartridge and the secondary cartridge in the predetermined rotational orientation.

In embodiments, the contents of the primary cartridge may include at least one or more of a fluoride, abrasive, humectant, and detergent. In addition, the contents of the secondary cartridge may include at least flavorings and food colorings.

The contents of each of the primary cartridge and the secondary cartridge may be in the form of a gel or a paste.

In embodiments, the primary cartridge and the secondary cartridge may be sized to dispense through the nozzle no more than a predetermined volume of the components that equals a single use dollop of the personalized toothpaste.

In other embodiments, the device is configured, in cooperation with the dispenser, to dispense a predetermined single use dollop of the personalized toothpaste.

In further embodiments, the contents of the secondary cartridge may be arranged in vertically ordered columns, each vertically ordered column including a different flavoring, and wherein each different flavoring has a different color.

The housing of the device includes a front side and a back side, and in embodiments, further includes a mounting component positioned on the back side, wherein the mounting component is configured to attach to or hang from a mating mounting component that is fixed to a vertical surface, with the nozzle of the housing facing downward.

The device may include the dispenser operably connected to the housing for use.

The present disclosure is also directed to a system including any of the embodiments of the device, and further including, in embodiments, the dispenser operably connected with the housing in use.

The system may further include an external component connectable to the nozzle, and a connector fixedly positioned on the second end of the housing, wherein the external component includes a complementary connector configured to removably attach the external component to the housing via the connector and to be in fluid connection with the nozzle.

The external component may include an attachable adaptor configured to attach the nozzle to an open end of a toothpaste tube for dispensing the personalized toothpaste into the toothpaste tube.

In embodiments, the dispenser of the system includes a plunger insertable into the first end of the housing and alignable in fluid connection with each of the primary cartridge and the secondary cartridge, wherein in use, the personalized toothpaste is dispensed by a user applying a force on the plunger to move the components from each of the primary and the secondary cartridge into, through, and out of the nozzle.

In other embodiments, the dispenser of the system includes a vacuum-operable dispenser including a second nozzle in fluid connection with an output end of the nozzle, wherein the vacuum-operable dispenser includes a vacuum extrusion pump that forms a vacuum seal at the exit end of the nozzle, a valve operable to release the vacuum seal, and a depressible tab operably connected to the valve. In use, the personalized toothpaste is dispensed by a user pushing a toothbrush against the depressible tab thereby opening the valve and releasing the vacuum seal to move the components from each of the primary and the secondary cartridge into, through, and out of the nozzle and the second nozzle.

The present disclosure is also directed to a kit for creating, storing, and dispensing a personalized toothpaste. The kit includes a device for blending and dispensing a personalized toothpaste, a primary cartridge filled with at least one or more of a fluoride, abrasive, humectant, and detergent; and at least one of a secondary cartridge, wherein the at least one of the secondary cartridge includes at least one of a flavoring and a food coloring. The device includes a housing, which includes a first end and a second end, and a first retaining chamber and a second retaining chamber parallel to the first retaining chamber and positioned perpendicularly between the first end and the second end. Each of the first retaining chamber and the second retaining chamber is sized and shaped to receive therein and remove therefrom, respectively, one of the primary cartridges and one of the secondary cartridges provided in the kit, which are configured to be interchangeable with other primary cartridges and secondary cartridges in the kit. The device also includes a nozzle extending from the second end of the housing and aligned in fluid connection with both the primary cartridge and the secondary cartridge to receive the components therefrom. The housing is operably connectable with a dispenser that is operable to move the components from each of the primary and the secondary cartridge into, through, and out of the nozzle to dispense the personalized toothpaste in use, wherein the personalized toothpaste exiting the nozzle is a blend of the components from the primary cartridge and the secondary cartridge.

The housing of the device provided in the kit includes a front side and a back side, and may include a mounting component positioned on the back side, which is configured to attach to, or hang from, a complementary mounting component that is fixed to a vertical surface, with the nozzle of the housing facing downward. The kit further includes, in embodiments, a mounting assembly that includes the complementary mounting component and may also include mounting hardware.

The kit may also include at least one external component configured to connect to the second end of the housing in fluid connection with the nozzle. The device of embodiments of the kit may further include a connector fixedly positioned on the second end of the housing. The at least one external component includes a complementary connector configured to removably attach the at least one external component to the housing via the connector and to be in fluid connection with the nozzle.

In embodiments, the kit further includes at least one toothpaste tube, and wherein the at least one external component includes an attachable adaptor configured to attach the nozzle to an open end of the at least one toothpaste tube for dispensing the personalized toothpaste into the toothpaste tube. The attachable adaptor, in embodiments, includes the complementary connector, a bore hole that fluidly connects the nozzle to an interior of the toothpaste tube in use, and threads on an interior diameter for threadedly engaging the attachable adaptor to the toothpaste tube via its outer diameter, such that operation of the dispenser with the attachable adaptor positioned on the toothpaste tube and connected via the connector and the complementary connector to the housing dispenses the personalized toothpaste into the toothpaste tube.

The kit may include a plurality of the secondary cartridges, each filled with a different flavoring.

In further embodiments, each primary cartridge and secondary cartridge includes a peel-off covering on at least one of its ends, the peel-off covering being removed prior to installation in the cartridges.

In embodiments of the device of the kit, the first and the second retaining chamber each include an alignment element positioned to receive the primary cartridge and the secondary cartridge in a predetermined rotational orientation, and each of the primary cartridge and the secondary cartridge includes a complementary alignment element that cooperates with the alignment element to seat each of the primary cartridge and the secondary cartridge in the predetermined rotational orientation.

The kit may further include the dispenser.

In embodiments, the dispenser includes a plunger insertable into the first end of the housing and alignable in fluid connection with each of the primary cartridge and the secondary cartridge, wherein in use, the personalized toothpaste is dispensed by a user applying a force on the plunger to move the components from each of the primary and the secondary cartridge into, through, and out of the nozzle.

In further embodiments, the dispenser may include a vacuum-operable dispenser in fluid connection with an output end of the nozzle, wherein the vacuum-operable dispenser includes a vacuum chamber that forms a vacuum seal at the exit end of the nozzle, a valve operable to release the vacuum seal, and a depressible tab operably connected to the valve, wherein in use, the personalized toothpaste is dispensed by a user pushing a toothbrush against the depressible tab thereby opening the valve and releasing the vacuum seal to move the components from each of the primary and the secondary cartridge into, through, and out of the nozzle.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

FIG. 2 is a pictorial representation of a second (exit) end view of the interchangeable cartridges shown in the embodiment in FIG. 1A.

FIG. 3A is a pictorial representation of a perspective side view of a second (exit) end of an embodiment of a housing and a nozzle extending therefrom of the present disclosure.

FIG. 3B is a pictorial representation of an end view of the second (exit) end of the housing of FIG. 3A.

Figure 1A:
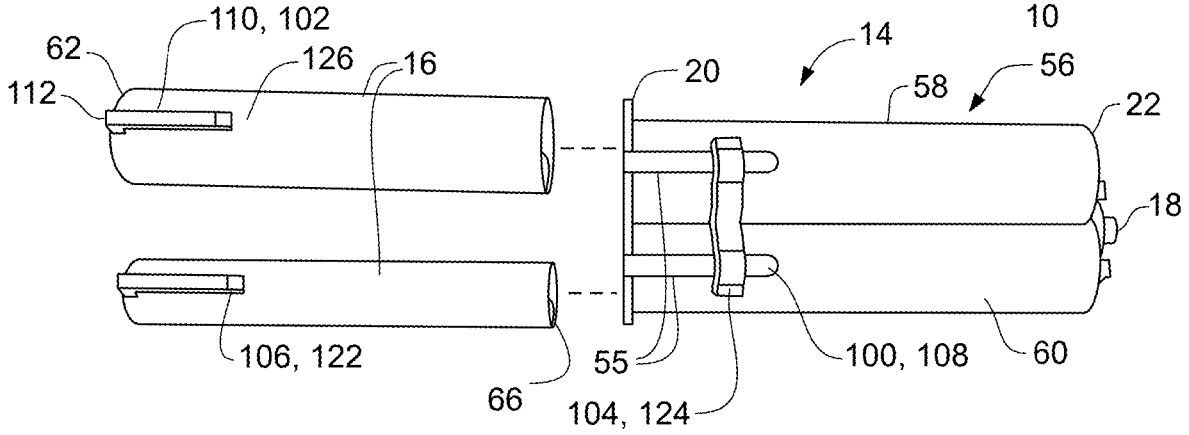
FIG. 1A is a pictorial representation of an exploded front view of component parts of an embodiment of a device for blending a personalized toothpaste of the present disclosure, the component parts including a housing and interchangeable cartridges insertable therein, which are filled, in use, with components of a toothpaste.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a device and system for mixing and dispensing a personalized toothpaste as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed to a device and a system for personalizing a toothpaste. The present disclosure is also directed to a device and system for personalizing a toothpaste that may be attractive for use by children, with the advantageous effect of encouraging children to brush their teeth on a daily basis.

Figure 4A:
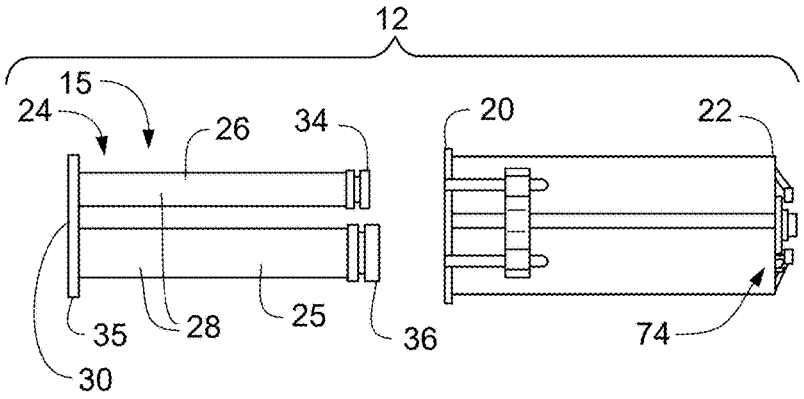
FIG. 4A is a pictorial representation of an exploded front view of an embodiment of a system for dispensing personalized toothpaste including the assembled device of FIG. 1A and an embodiment of a dispenser, in this case, a plunger, connectable thereto for moving components of a toothpaste from the interchangeable cartridges out through the nozzle of the housing.
Figure 4B:
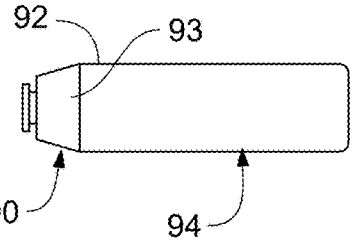
FIG. 4B is a pictorial representation of an external component, in this case, a toothpaste tube including a complementary connector assembled on an input end of the toothpaste tube for connecting to a second (dispensing) end of the housing.
Figure 8:
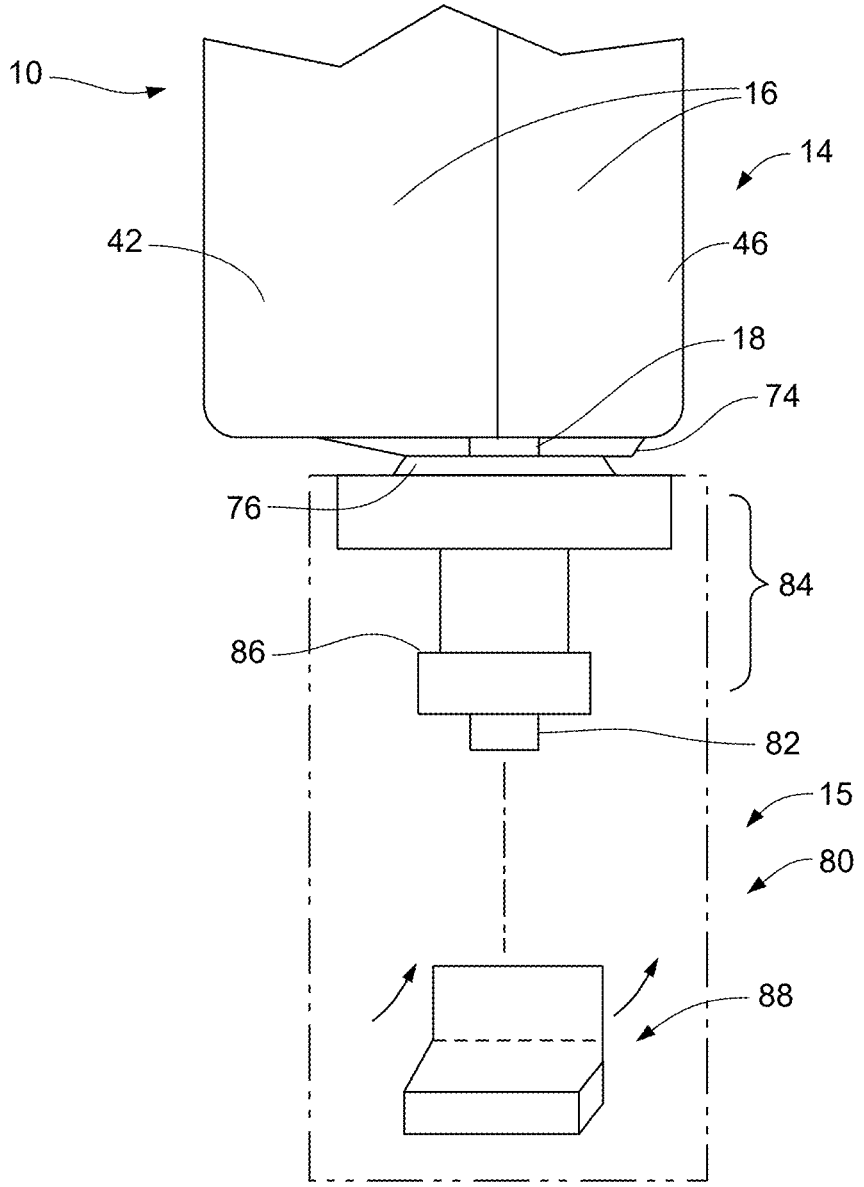
FIG. 8 is a pictorial representation of a front view of another embodiment of a system, for dispensing personalized toothpaste in this case, directly onto a toothbrush, including any of the embodiments of a housing and interchangeable cartridges of the present disclosure, and an embodiment of a dispenser, in this case, a vacuum-operable dispenser, connectable to the nozzle of the housing for moving components of a toothpaste from the interchangeable cartridges out through the nozzle of the housing.

The terms "mating" and "complementary" are used interchangeably to refer to one half of a connector assembly, for example, a connector assembly may include a (e.g., male) connector of the connector assembly which fits or interconnects with a "complementary" or "mating" (e.g., female) connector. For example, an "alignment element" and a "mating alignment element" on two different interconnecting parts of the device of the present disclosure together form a connector assembly for connecting the two parts together in a predetermined rotational orientation. The phrase "alignment element" is used as a naming convention for the connector assembly on those particular parts of the device and is not intended to invoke a means-plus-function interpretation. Likewise a "connector" on one component and a "complementary" or "mating connector" on another interconnecting component of the system of the present disclosure Referring to FIGS. 1A-1C, an embodiment of a device 10 for personalizing a toothpaste includes a housing 14 configured to retain at least two cartridges 16 (FIG. 1), which may be in the shape of tubes or cylinders in embodiments. Each cartridge 16, which may be referred to as a tube or cylinder in regard to the embodiments shown in the figures, contains, and particularly for the kits of the present disclosure is preferably prefilled with, one or more components of a toothpaste, which when mixed or blended form a personalized toothpaste of the present disclosure. In embodiments, each of the cartridges 16 is separately insertable, removable, and replaceable with a different cartridge 16', i.e., interchangeable. In other embodiments, the cartridges 16 may form a single unit that is interchangeable with another unit comprising the two cartridges. Referring to FIGS. 1A, 1B, 3A and 3B, for example, the housing 14 includes a nozzle 18, a first (insertion) end 20 and a second (extrusion) end 22. In embodiments, the nozzle 18 is a hollow cylinder that extends from the second end 22 of the housing. When the cartridges 16 are installed in the housing 14 for use, an entrance port 40 of the nozzle 18 is aligned in fluid connection with both cartridges 16 to receive and blend together the components therefrom within the nozzle 18 for extrusion directly onto a user's toothbrush, or in embodiments, into a toothpaste tube for later use. Referring to FIGS. 4A and 8, for example, the housing 14 is connectable to, and in embodiments, is configured to fluidly connect the components of the two cartridges 16 to, a dispenser 15 (FIG. 4A), 15' (FIG. 8) that is operable to move the components from each of the cartridges 16 into, through, and out of the nozzle 18 to dispense the personalized toothpaste in use, wherein the personalized toothpaste exiting the nozzle 18 is a blend of the components from the cartridges 16.

Referring again to FIG. 4A and FIG. 8, for example, an embodiment of a system 12 and 32, respectively, may include an embodiment of the device 10 of the present disclosure and at least an embodiment of the dispenser 15, 15', for example.

In an embodiment of the system 12, referring to FIGS. 4A, the dispenser 15 includes a plunger 24. The plunger 24 may be formed of two connected plungers 28 slidably insertable via the first end 20 of the housing 14 into each cartridge 16 retained in the housing 14 and each of the connected plungers 28 is configured to move the contents or components of each cartridge 16 toward the second end 22 of the housing 14. In the embodiments shown, the two connected plungers 28, a first plunger 25 and second plunger 26, are cylinders that fit into cartridges 16, which in embodiments, are of a tubular shape. The connected plungers 28 are connected together, in embodiments, at an outer end 30 of the plunger 24, which may include a protruding rim 35, in embodiments, to ensure the contents in each cartridge 16, which form the components of the toothpaste, are moved simultaneously, at the same rate, toward the second end 22 of the housing 14. In embodiments, an inner end 34 of each of the connected plungers 28, which is slidably inserted into each cartridge 16, has a flat, solid end surface 36, for moving, or pushing, the contents of each cartridge 16 toward the second end 22 of the housing 14 and into the nozzle 18.

In embodiments, such as the device shown in FIG. 4A, the two connected plungers 28 may be in the shape of two cylinders. In further embodiments, the plunger 24 may be any suitable plunger 24 that is appropriately sized and shaped for the cartridges 16 used. It should be apparent to one of ordinary skill in the art that cartridges 16 in the shape of a rectangular prism, or any other suitable shape, are within the scope of the present invention, together with a suitably shaped plunger 24 and housing 14 to accommodate the shape of the cartridges 16.

In embodiments of the device 10, the cartridges 16 may each have the same diameter, with each of the two connected plungers also having the same diameter, such that equal amounts of the contents of each are blended together to form the personalized toothpaste extruded from the nozzle 18.

Referring still to FIG. 4A, the cartridges 16, in embodiments, may be referred to as a primary cartridge 42 and a secondary cartridge 46, and are also referred to herein as an interchangeable primary cartridge 42 and interchangeable secondary cartridge 46 for emphasis. The primary cartridge 42 contains components found in most commercial toothpastes, and may include at least one or more of a fluoride, abrasive, humectant, and detergent, and may be, in embodiments, in the form of a paste. In other embodiments, the components or contents are in the form of a gel. The components of the secondary cartridge 46 of the at least two cartridges 16, in embodiments, include flavorings and food colorings, and may additionally include, in embodiments, some or all of the components contained in the primary cartridge 42. The personalized toothpaste is formed by insertion of a user's choice of a secondary cartridge 46 in the housing 14, based on which flavorings and colorings are included in the secondary cartridge 46 that is chosen.

In embodiments, one of the cartridges 16, in one embodiment, the primary cartridge 42, has a diameter that is larger than that of the other, in one embodiment, the secondary cartridge, such that more of the contents of the larger cartridge are extruded out through the nozzle 18 than the contents of the smaller cartridge, which may be the flavorings and colorings in the secondary cartridge 46. In particular embodiments, the diameter of one of the cartridges 16, in embodiments, the primary cartridge 42, is two times, and in further embodiments, four times, larger that the diameter of the other cartridge 16, in embodiments, the secondary cartridge 46. In the system 12 shown in FIG. 4A, wherein the dispenser 15 includes connected plungers 28, each of the connected plungers 28 is sized to fit into the diameter of each of the primary 42 and secondary cartridges 46.

In the device 10 shown in the accompanying figures, the housing 14 has a substantially oval cross-sectional profile due to the configuration of the cartridges 16 being positioned side by side and parallel to one another, and due to the cylindrical shape of the cartridges 16 shown in the embodiment. In other embodiments, the cross-sectional profile may be rectangular.

It should be noted that plungers are known in the prior art for mixing two-component adhesives, but these are configured with the components already loaded into each side of a dual cartridge unit, into which the plunger is directly inserted. A mixing nozzle is also required to be attached to the output spout of the cartridge unit for mixing the two-component epoxy, and the output spout of the commercial systems require a divider to prevent mixing of the components within the output spout. In contrast, the nozzle 18 of the device of the present disclosure is hollow, such that the components from each of the two cartridges 16 mix or blend together within the nozzle 18. There is no known structure which includes a housing which allows each cartridge 16 individually, or in embodiments as a unit including two cartridges, filled with the components or not, to be inserted, and removed, and replaced with another, as is the case with the interchangeable cartridges 16 and housing 14 of the present disclosure. There is likewise nothing in the prior art that contemplates the device of the present disclosure for personalizing toothpaste.

Figure 1B:
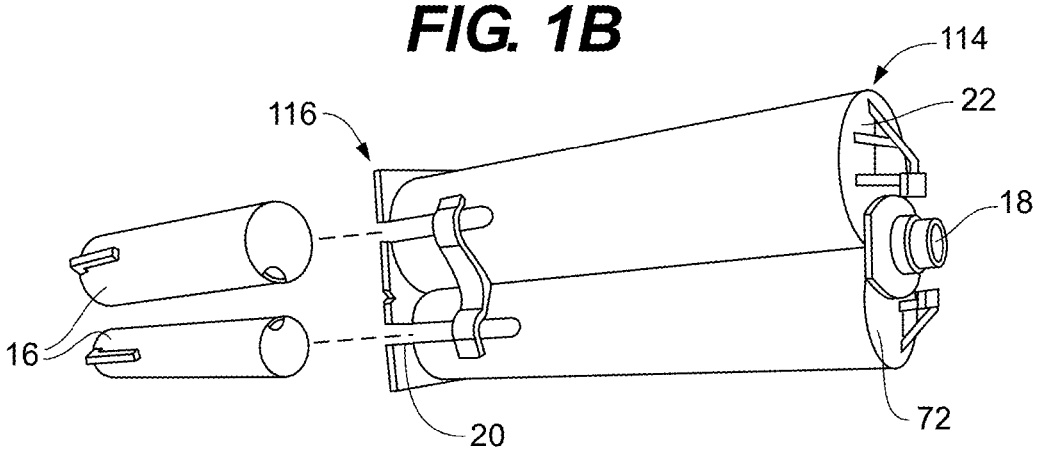
FIG. 1B is an exploded perspective front view of the component parts of FIG. 1A.
Figure 1C:
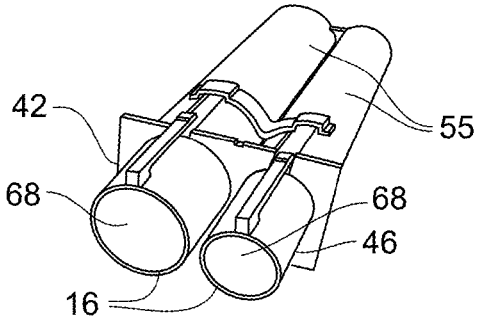
FIG. 1C is a perspective first (input) end view of the component parts of FIG. 1A, with the interchangeable cartridges partially assembled in the housing.

The interchangeability of the cartridges 16 in embodiments is facilitated in part by the construction of the housing 14, which includes retaining chambers 55, e.g., a first retaining chamber 58 and a second retaining chamber 60, as best shown in FIGS. 1A-1C, configured for positioning the cartridges 16, e.g., the primary cartridge 42 and the secondary cartridge 46, in a predetermined rotational orientation (also referred to herein as "predetermined orientation") in the housing 14, such that the contents of each of the cartridges 16 are in fluid communication with the entrance port 40 of the mixing nozzle 38. The second retaining chamber 60 is parallel to the first retaining chamber 58 and positioned perpendicularly between the first end 20 and the second end 22 of the housing 14. Each of the first 58 and the second retaining chamber 60 is sized and shaped to receive therein and remove therefrom, respectively, the interchangeable primary cartridge 42 and the interchangeable secondary cartridge 46.

In embodiments, referring to FIGS. 1A, 1C, for example, each retaining chamber 55 is formed in a body 56 of the housing 14, and in further embodiments, is formed as a hollow cylinder bored into the body 56.

Embodiments of the housing 14 and the cartridges 16 as shown in the figures are configured to individually install each cartridge 16 in the housing 14 in a predetermined orientation for fluid communication with the nozzle 18 and to individually remove each cartridge 16 for replacement. It should be understood that the same features for aligning, and, optionally, locking the cartridges 16 in a predetermined orientation may be positioned on a unit (not shown) that includes both cartridges 16 for aligning and locking the unit and thereby the cartridges 16 in the predetermined orientation.

Referring to FIGS. 1A and 1B, each cartridge 16 has a first (input) end 62 and, referring also to FIG. 2, a second (output) end 66 and, an interior 68 (FIG. 1C), which in embodiments is formed as the interior 68 of a hollow cylinder for holding the components of the toothpaste. In embodiments, the cartridges 16 are pre-filled with the components.

In embodiments, as shown in FIG. 2, each cartridge 16 has an end surface 64, which is solid, except for an opening, or cutout 70, and in embodiments, flat. An interior surface 72 of the second end 22 of the housing is preferably shaped to the contour of the end surface 64. In the embodiments shown in FIGS. 1A-5D, as inferred, for example, from FIGS. 1A, 3A, 3B, the interior surface 72 of the housing 14 is also flat, so that the end surface 64 of each cartridge 16 abuts the interior surface 72 of the housing 14.

Figure 6A:
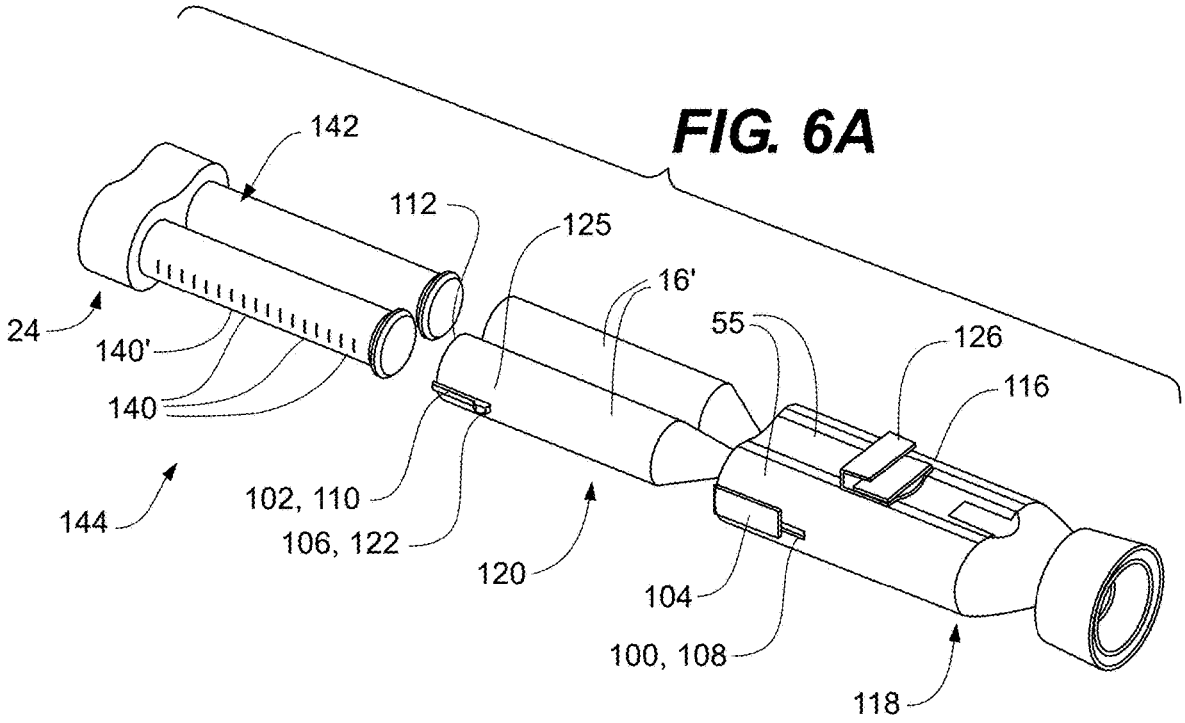
FIG. 6A is a pictorial representation of an exploded side view of another embodiment of a system, for dispensing personalized toothpaste into, for example, a toothpaste tube, including another embodiment of a housing and interchangeable cartridges, and an embodiment of a dispenser, in this case, a plunger, connectable thereto for moving components of a toothpaste from the interchangeable cartridges out through the nozzle of the housing.
Figure 6B:
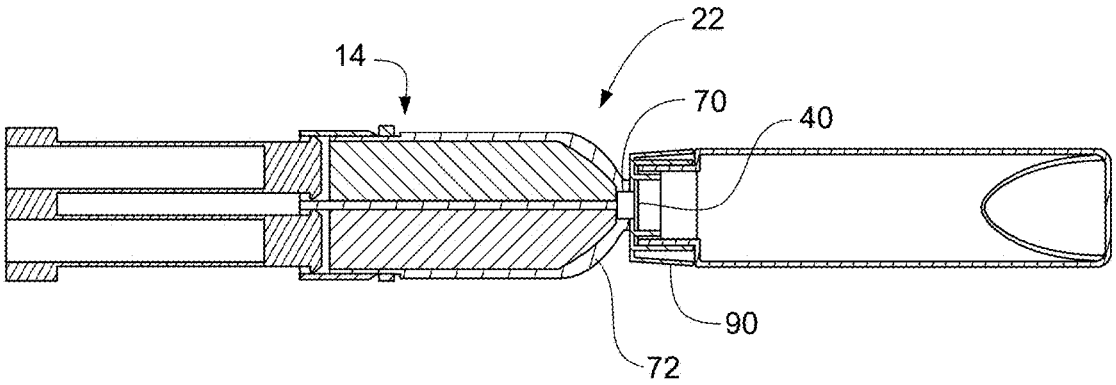
FIG. 6B is a pictorial representation of the system of FIG. 6A, assembled with the dispenser and toothpaste tube.
Figure 7A:
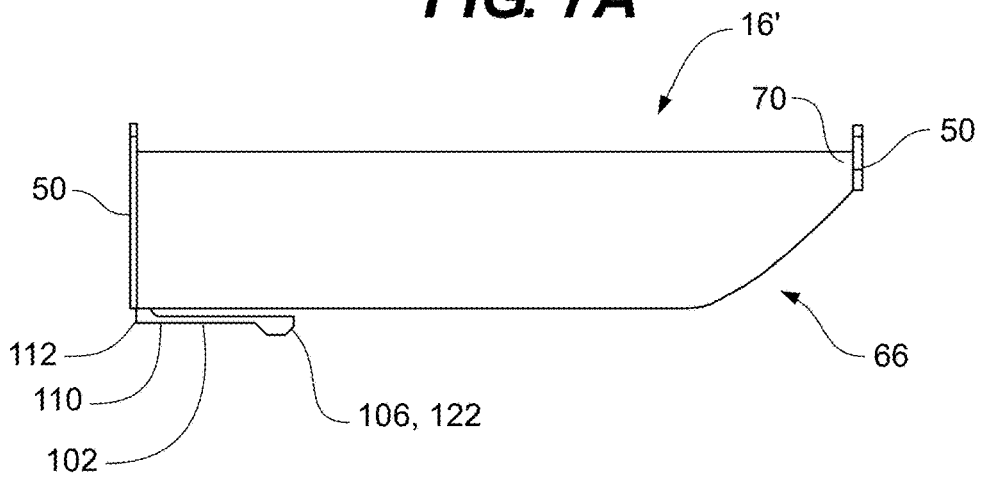
FIG. 7A is a pictorial representation of a side view of an embodiment of the interchangeable cartridges for assembling in the system of FIG. 6A.

In a different embodiment shown in FIGS. 6A, 6B, 7A the end surface 64 of each cartridge 16' is solid, except for the opening 70, and is tapered inward. The interior surface 72 of the housing 14 is likewise tapered to follow the contour of the second end 66 of the cartridge 16' (see FIG. 7A). For use as installed, the cartridges 16 are oriented in the housing 14 (the orientation of the openings 70 is best shown in FIG. 2 and in FIG. 3B) such that the openings 70 are adjacent to each other and aligned within the inner diameter of the entrance port 40 of the nozzle 18, such that each is in fluid communication with the entrance port 40 of the nozzle 18.

Figure 7B:
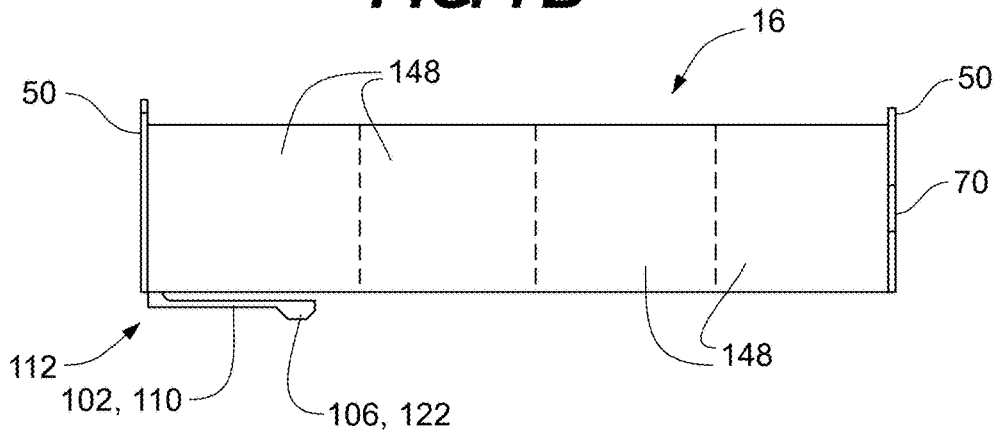
FIG. 7B is a pictorial representation of a side view of an embodiment of the interchangeable cartridges for assembling in the system of FIG. 4A.

Referring to FIGS. 7A, 7B, the cartridges 16, 16' may be provided pre-filled with the components of a toothpaste as an after-market product or with a kit formed in accordance with the present disclosure. In embodiments, each pre-filled cartridge 16, 16' may include a pull-off tab 50 over at least the first end 62, and in further embodiments, likewise over the opening 70 in the second end 66.

As described herein, the components, or contents, of each one of the cartridges 16, once the cartridges 16 are loaded and aligned in the proper predetermined orientation for use in the housing 14, are moved from each of the primary and the secondary cartridge into, through, and out of the nozzle to dispense the personalized toothpaste in use, wherein the personalized toothpaste exiting the nozzle is a blend of the components from the primary cartridge and the secondary cartridge. In embodiments, wherein the dispenser 15 includes plungers 28, the contents may be pushed down and out of the cartridge 16 by a user applying a pushing force, in embodiments, on the outer end 30, such that the flat, solid end surface 36 of each of the connected plungers 28 is translated to move the contents through the nozzle 18.

However, any dispenser 15 may be configured with a device formed in accordance with the present disclosure to move the components from the cartridges 16 into, through, and out of the nozzle 18 to dispense the personalized toothpaste in use. The personalized toothpaste may be dispensed directly onto a user's toothbrush or into a toothpaste tube for later use.

For example, another embodiment of a dispenser 15 may include an automated vacuum extrusion dispenser 80, represented in FIG. 8. The vacuum extrusion dispenser 80 includes a second (output) nozzle 82 of the vacuum extrusion dispenser 80, which is aligned in fluid communication with the nozzle 18 of the device 10, which in turn is aligned in fluid connection with both the primary cartridge 42 and the secondary cartridge 46 to receive the components therefrom. The vacuum-operable dispenser 80 includes a vacuum extrusion pump 84 that forms a vacuum seal at the end of the second nozzle 82, a valve 86 operable to release the vacuum seal, and a depressible tab 88 operably connected to the valve 86, wherein in use, the personalized toothpaste is dispensed by a user pushing a toothbrush against the depressible tab 88 thereby opening the valve 86 and releasing the vacuum seal to move the components from each of the primary 42 and the secondary cartridge 46 into, through, and out of the nozzle 18 and the second nozzle 82 to dispense the personalized toothpaste directly onto a toothbrush.

Figure 4C:
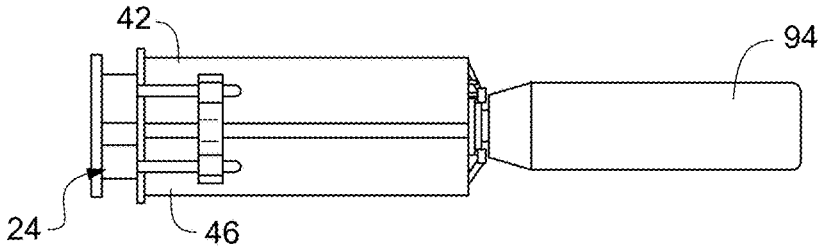
FIG. 4C is a pictorial representation of an embodiment of a system including the system of FIG. 4A, assembled with the toothpaste tube of FIG. 4B.

In embodiments, still referring to FIG. 8 and to FIGS. 3A, 3B, 4A, 4D, for example, the housing 14 may include a connector 74 fixedly positioned on the second end 22 of the housing 14 for connecting an external component 75 thereto. The external component 75 may be a component of the vacuum extrusion pump 84, for example. In other embodiments of the system represented in FIGS. 4A-4D, the external component 75 may include an attachable adaptor 90 configured to attach the nozzle 18 to an open end, and in fluid communication with the interior 92, of a toothpaste tube 94, via a bore hole 73 though the attachable adaptor 90 for dispensing the personalized toothpaste into the toothpaste tube 94, as shown in FIG. 4C. The connector 74 is configured, in embodiments, to removably attach to a complementary connector 76 on the external component 75.

In embodiments, the connector 74 and the complementary connector 76 may form any suitable connector assembly known in the prior art, and may include, but are not limited to, snap-fit connectors, and twist and lock connectors.

To connect the external component 75 to the housing 14 without interfering with the flow through the nozzle 18, the connector 74 may include, in embodiments, connecting elements 78 positioned on either side of the nozzle 18, and the external component 75 may include complementary connecting elements 79 (see FIG. 4D) positioned on either side of the bore hole 73 through the external component 75 for interconnecting with the connecting elements 78 and fluidly connecting the toothpaste tube 94 with the nozzle 18.

Figure 4D:
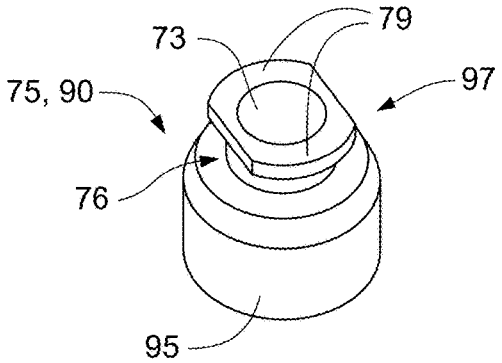
FIG. 4D is a pictorial representation of a connector configured to removably attach the housing to the toothpaste tube of FIG. 4B.

In other embodiments, the external component 75 may be an attachable ring including the complementary connector 76, e.g., as shown on the attachable adaptor 90 in FIG. 4D, configured to interchangeably attach the attachable ring to the nozzle 18, wherein the attachable ring is shaped and configured to alter the perimetral shape of the personalized toothpaste dispensed in use from the device from its otherwise circular shape.

Figure 5A:
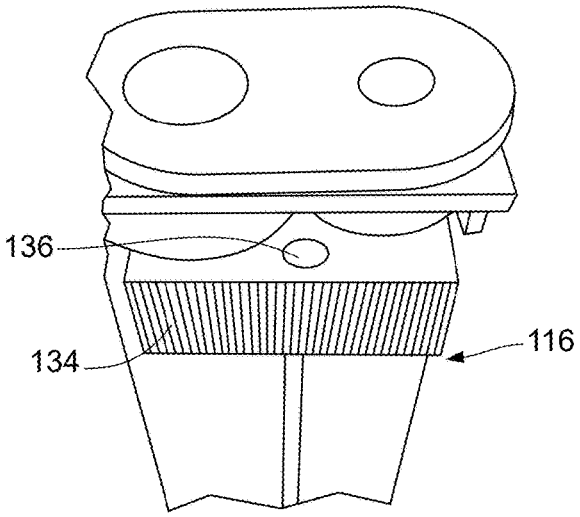
FIG. 5A is a pictorial representation of a portion of a back of an embodiment of a housing of the present disclosure, showing an embodiment of a mounting component.
Figure 5B:
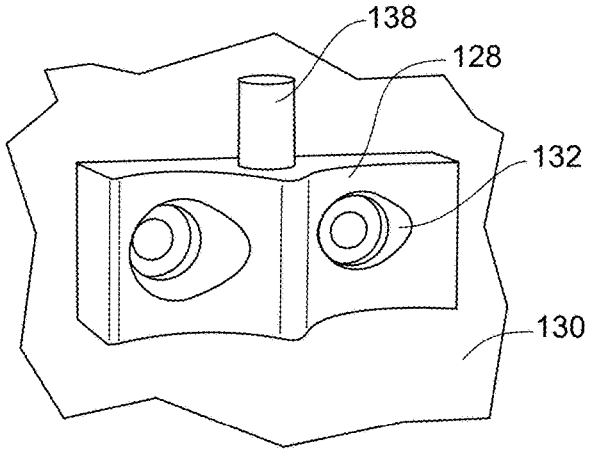
FIG. 5B is a pictorial representation of an embodiment of a complementary mounting component assembled on a vertical surface configured for mounting the housing of FIG. 5A thereto via the mounting component.
Figure 5C:
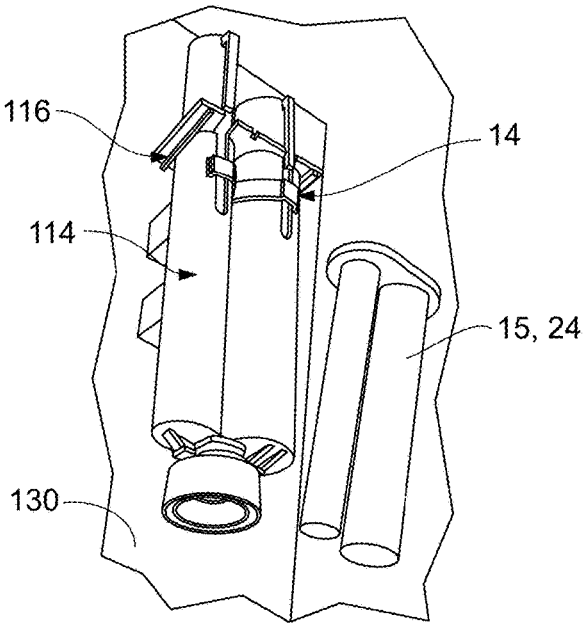
FIG. 5C is a pictorial representation of an embodiment of a device of the present disclosure partially assembled and aligned for mounting to a vertical surface via embodiments of the mounting component and the complementary mounting component.
Figure 5D:
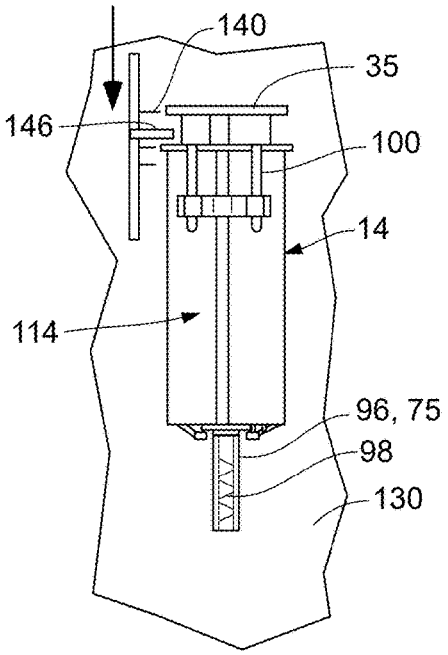
FIG. 5D is a pictorial representation of another embodiment of a device of the present disclosure mounted on a vertical surface, and including a mixing nozzle interchangeably connected to the nozzle of the housing.

In still other embodiments, referring to FIG. 5D, the external component 75 may be an extended nozzle 96, which may include baffles 98 for static mixing of the components from the primary cartridge 42 and secondary cartridge 46 as they move from the nozzle 18 through the extended nozzle 96.

In embodiments, methods for personalizing toothpaste in accordance with the present disclosure includes providing any of the embodiments of the device of the present disclosure. The method may further include loading the primary cartridge 42 and the choice of the secondary cartridge 46 from a variety of cartridges 16 provided, for example, in a kit, in the housing 14 of the device 10. The method additionally includes providing a dispenser, connecting the dispenser 15 to the housing 14 and in fluid connection with the contents of the cartridges 16, and operating the dispenser to move the components from each of the primary 42 and the secondary cartridge 46 into, through, and out of the nozzle 18 to dispense the personalized toothpaste in use. The personalized toothpaste exiting the nozzle 18 is a blend of the components from the primary cartridge 42 and the secondary cartridge 46. In embodiments, the dispenser 15 includes a plunger 24, the method including depressing a plunger 24 into a first (input) end of the cartridges 16 to move the components from each of the primary 42 and the secondary cartridge 46 into, through, and out of the nozzle 18 to dispense the personalized toothpaste in use directly onto a brush for immediate use.

In other embodiments, the dispenser 15 is the vacuum extrusion dispenser 80, the method including a user pushing the depressible tab 88 with a toothbrush thereby opening a valve 86 that releases the vacuum seal at the nozzle 18 to move, e.g., extrude, the components from each of the primary 42 and the secondary cartridge 46 into, through, and out of the nozzle 18 and the second nozzle 82 to dispense the personalized toothpaste directly onto the toothbrush for immediate use.

In additional embodiments, referring again to FIGS. 4A-4D, the personalized toothpaste may be dispensed into a toothpaste tube 94 for later use. Embodiments of a method for dispensing a personalized toothpaste into the toothpaste tube 94 may include providing a toothpaste tube 94, removing a cap from the toothpaste tube 94 and replacing it with the attachable adaptor 90 shown in FIG. 4D, for example, which includes a threaded inner diameter 95 for threadedly connecting the attachable adaptor 90 to the toothpaste tube 94, via threads 93 on the outer diameter of the open end 92 of the toothpaste tube 94, and connecting a proximal end 97 of the attachable adaptor 90, in embodiments, via the complementary connector 76, to the nozzle 18 of the device 10. The method further includes operating the dispenser 15 to move the components from each of the primary 42 and the secondary cartridge 46 into, through, and out of the nozzle 18 and into the toothpaste tube 94 via the attachable adaptor 90 to dispense the personalized toothpaste into the toothpaste tube 94 for later use. Once an acceptable amount of the personalized toothpaste is dispensed into the toothpaste tube 94, the method may include detaching the attachable adaptor 90 from the toothpaste tube 94 and reattaching the cap provided with the toothpaste tube 94 to store for later use.

In embodiments of the devices, systems, and methods of the present disclosure, the cartridges 16 are preferably installed or loaded in a predetermined orientation in the housing 14, as described herein, for fluidly connecting the nozzle 18 to the contents of the cartridges 16 via the openings 70, and the cartridges 16 and the housing 14 are configured to insure the installation in the predetermined orientation. In embodiments of the method and device of the present disclosure, before the step of loading or installing the cartridges 16, the tab(s) 50, if provided on the cartridges 16, are first removed from the ends of each of the primary 42 and secondary cartridges 46 chosen by the user to obtain the desired qualities of the personalized toothpaste. Each of the primary 42 and secondary cartridges 46, in embodiments, is then loaded, in embodiments, into a corresponding one of the retaining chambers 55 of the housing 14 that the cartridge 16 fits into, in a predetermined rotational orientation, and with the output end 66 of the cartridge 16 inserted first so that it is adjacent the nozzle 18 upon installation. In embodiments, the cartridges 16 are loaded prior to coupling, or operably connecting, the housing 14 with the dispenser 15.

Referring to FIGS. 1A, 6A, and 7A, 7B, for example, at least one of the retaining chambers 55 and at least one of the cartridges 16 is preferably configured with an alignment element 100, 102, respectively, for positioning the cartridges 16 in fluid connection with the nozzle 18. In embodiments, the first 58 and the second retaining chamber 60 each includes an alignment element 100 positioned to receive the primary cartridge 42 and the secondary cartridge 46, respectively, in a predetermined rotational orientation, and each of the primary cartridge 42 and secondary cartridge 46 includes a mating alignment element 102 that cooperates with the alignment element 100 to seat each of the primary cartridge 42 and secondary cartridge 46 in the predetermined rotational orientation. In embodiments in which each cartridge 16 is independently insertable in the housing 14, each retaining chamber 55 and each cartridge 16 includes an alignment element 100 and mating alignment element 102. In embodiments in which the cartridges 16 are connected to form a single unit, either one or both cartridges 16 and the corresponding one or both retaining chambers 55 may include alignment and mating alignment elements 100, 102.

In further embodiments, the alignment and mating alignment elements 100, 102 may further include a reversible locking element and mating locking element 104, 106, respectively, for retaining the cartridges 16 in the retaining chambers 55 until the reversible locking elements 104, 106 are disengaged by a user.

The alignment and mating alignment elements 100, 102 with reversible locking elements 104, 106 may include, but are not limited to, any suitable reversible locking connector, such as a clip-type connector assembly, or a snap-fit connector assembly.

In embodiments, the alignment element 100 on the retaining chamber 55 may be a groove, depression, or a cutout and the alignment element 102 on the cartridge 16 may be an arm, pin, or any protrusion 110 attached at least to a proximal end 112 to the cartridge 16, wherein the alignment elements 100, 102 are positioned such that sliding the arm 110 along the groove 108 to install the cartridge 16 orients the opening 80 of the cartridge 16 in fluid connection with the nozzle 18. In the embodiment of FIGS. 1A-1C, for example, the alignment elements 102 are positioned on a front side 114 of the housing 14, and the openings 70 are rotationally oriented inward by ninety degrees, in opposite directions, so that the openings 70 in the cartridges are adjacently positioned when the cartridges 16 are assembled via the alignment elements 100, 102. In the embodiment of FIGS. 6A, 6B, the alignment elements 100, 102 are positioned on an outer side 118 of each of the retaining chambers 55, and an outer side 120 of the cartridges 16, when installed, so that the openings 70 are rotationally aligned 180 degrees from the alignment elements 100, 102. As one of skill in the art will appreciate, any number of possible positions of the alignment elements 100, 102 is feasible, as long as the correct relative orientation of the openings 70 in the cartridges 16 is maintained.

Still referring to FIGS. 1A, 6A, and 7A, 7B, in embodiments, the arm 110 on the cartridges 16 may be a deflectable arm 110, and the reversible locking element 104 on the retaining chamber 55 may include a catch 124, which may be a bar 124 over a central portion of the groove 108. The mating reversible locking element 106 then preferably includes a protrusion 122 on a distal end 125 of the deflectable arm 110. In use, the deflectable arm 110 deflects downward as the protrusion 122 slides under the catch 124, and deflects upward once the protrusion 122 passes the catch 124 and clicks into position for use. The cartridge 16 remains in that position until a user pushes down on the protrusion 122 and slides the deflectable arm 110 back past the catch 124 to remove the cartridge 16.

In embodiments, the reversible locking elements 104, 106 may include any suitable connector and mating connector for interlocking the cartridges 16 in the predetermined orientation to the housing 14, including, but not limited to, a clip, snap-fit, or detent connector.

Referring now to FIGS. 5A-5D, the housing 14 includes the front side 114, as also referenced in FIG. 1A, and a back side 116 opposite the front side 114. In embodiments, a mounting component 126 is positioned on the back side 116, wherein the mounting component 126 is configured to attach to or hang from a mating mounting component 128 that is fixed to a vertical surface 130, which may be a wall in embodiments, via mounting hardware 132, for example, such as screws, nails, and so on, with the nozzle of the housing facing downward. The mounting component 126 and mating mounting component 128 may comprise two parts that together form any suitable mounting assembly, including, but not limited to, two parts of a French cleat system. In the embodiment of FIG. 6A, for example, the mounting component 126 is a part of a French cleat system configured to hang from an appropriately shaped mating mounting component 128. In the embodiment shown in FIGS. 5A-5D, the mounting component 126 includes a protruding bar 134 with a vertical borehole 136 therethrough, and the mating mounting component 128 includes a dowel 138 vertically positioned to accept the borehole 136 for mounting the housing 14 to the vertical surface 130.

The present invention is intended to encourage a child to adapt good daily dental hygiene habits by engaging the child in the process of flavoring, coloring, and personalizing the toothpaste the child will use. It is also a goal of the present invention to teach the child what is a suitable amount of toothpaste to use, referred to herein as a single use dollop of toothpaste.

Referring still to FIG. 6A, in a system in which the dispenser 15 is the plunger 24, the plunger 24 may include demarcations 140 on at least one of a front 142 and a side 144 of the plunger 24, wherein depressing the plunger 24 a distance into the primary 42 and the secondary cartridges 46 equal to the distance between a demarcation 140 and its neighboring demarcation 140' will dispense a predetermined volume of the personalized toothpaste suitable for a single use dollop. The child may line up one of the demarcations 140 with a top of the housing 14, for example, and with each use, depress the plunger 24 until the neighboring demarcation 140' is aligned with the top of the housing 14 or with another indicator provided on the housing 14. The demarcations 140, in embodiments, may be color coded to more easily identify how far to push the plunger 24 for a single use.

In other embodiments, referring to FIG. 5D, the demarcations 140 may be provided on the vertical surface 130 or on an overlay positioned on the vertical surface 130, e.g., a wall. In still further embodiments, referring to FIG. 5D, a slidable stop 146 may be provided on the vertical surface 130, wherein the slidable stop 144 is configured to allow a user to vertically slide it down from its initial position right below the rim 35 of the outer end 30 of the plunger 24, which also corresponds to a demarcation 140 to a predetermined locked position corresponding to the next demarcation 140'. In this way, the user can only push the plunger 24 until the rim 35 hits the properly positioned slidable stop 144. The slidable stop 144 would then need to be positioned downward to the next demarcation 140 for the next use.

In other embodiments, the dispenser 15 may be configured to dispense a single use dollop, for example, wherein the dispenser 15 is a vacuum extrusion dispenser 80.

In other embodiments, each of the interchangeable primary cartridge 42 and the interchangeable secondary cartridge 46 provided, in a kit, for example, is sized to dispense through the nozzle 18 no more than a predetermined volume of the components that equals a single use dollop of the personalized toothpaste.

In still other embodiments, each of the interchangeable primary cartridge 42 and the interchangeable secondary cartridge 46 provided, in a kit, for example, is sized to dispense through the nozzle 18 a plurality of single use dollops. In still other embodiments, referring, for example, to FIG. 7B, the contents of at least one of the secondary cartridges 46 provided, for example, in a kit, are arranged in vertically ordered columns 148, each vertically ordered column 148 including a different flavoring, and wherein each different flavoring has a different color, a volume of the contents in each of the vertically ordered columns 148 together with the contents of the primary cartridge 42 that will be simultaneously dispensed equals a single use dollop. Accordingly, dispensing only an amount of the personalized toothpaste of the same color will equal a single use dollop.

Figure 7C:
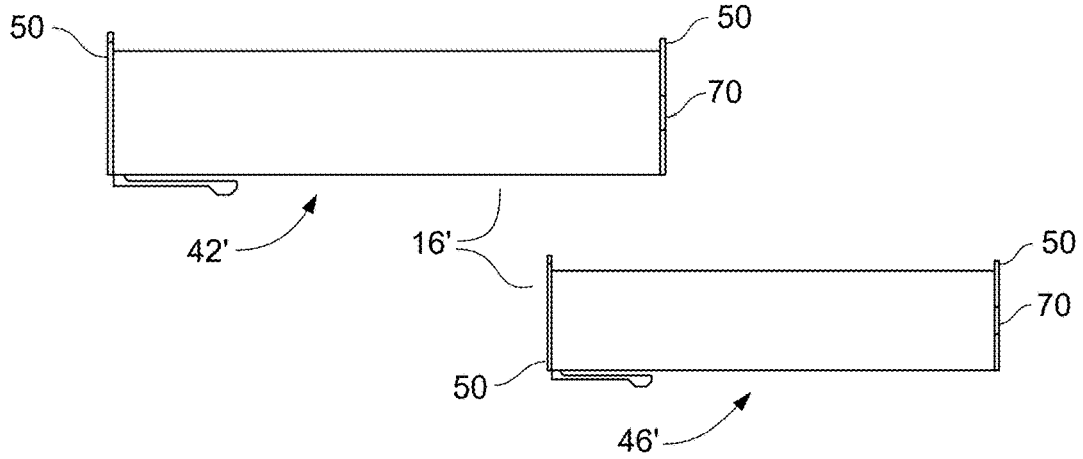
FIG. 7C is a pictorial representation of additional, different primary and secondary cartridges that are interchangeable with the primary and secondary cartridges provided with the device.

Embodiments of a kit of the present disclosure may include any of the embodiments of the device 10 of the present disclosure and may further include the primary cartridge 42, and in embodiments, at least one different cartridge 42' interchangeable therewith, referring to FIG. 7C, for example, filled with at least one or more of a fluoride, abrasive, humectant, and detergent. The kit may also include the secondary cartridge 46, and, in embodiments, at least one different secondary cartridge 46' replaceable therewith, wherein the secondary cartridge 46 and the at least one different secondary cartridge 46' includes at least one of a flavoring and a food coloring. In further embodiments, a plurality of the secondary cartridges 46, 46' is provided, each filled with at least one different flavoring, and/or at least one different coloring.

In embodiments, the kit may further include an embodiment of the mounting component 126, and in embodiments, also the mating mounting component 128, and in further embodiments, suitable hardware for mounting.

In further embodiments, the kit may include an embodiment of the dispenser 15. In further embodiment, the kit may include at least one toothpaste tube 94, and the attachable adaptor 90.

While particular embodiments of the present disclosure have been particularly shown and described with reference to specific embodiments, it should be apparent to those skilled in the art that the foregoing is illustrative only and not limiting, having been presented by way of example only. It is to be understood that the disclosed embodiments are merely examples of the disclosure, which may be embodied in various forms and detail without departing from the spirit and scope of the disclosure. Therefore, specific structural and functional details disclosed herein are not to be interpreted as limiting. Numerous other embodiments may fall within the scope of the accompanying claims and equivalents thereto.

What is claimed is:

1. A device for blending and dispensing a personalized toothpaste, comprising:

a housing including a first end and a second end, and a first retaining chamber and a second retaining chamber parallel to the first retaining chamber and positioned perpendicularly between the first end and the second end, and wherein each of the first retaining chamber and the second retaining chamber is sized and shaped to receive therein and remove therefrom, respectively, a primary cartridge and a secondary cartridge, which are configured to be interchangeable with different primary cartridges and secondary cartridges, respectively, wherein contents of each of the primary cartridge and the secondary cartridge include components of a personalized toothpaste; and a nozzle extending from the second end of the housing and aligned in fluid connection with both the primary cartridge and the secondary cartridge to receive the components therefrom;

wherein the housing is operably connectable with a dispenser that is operable to move the components from each of the primary and the secondary cartridge into, through, and out of the nozzle to dispense the personalized toothpaste in use, wherein the personalized toothpaste exiting the nozzle is a blend of the components from the primary cartridge and the secondary cartridge; and wherein the first and the second retaining chamber each includes an alignment element positioned to receive the primary cartridge and the secondary cartridge, respectively, in a predetermined rotational orientation, and each of the primary cartridge and the secondary cartridge includes a mating alignment element that cooperates with the alignment element to seat each of the primary cartridge and the secondary cartridge in the predetermined rotational orientation.

2. The device of claim 1, wherein the contents of the primary cartridge include at least one or more of a fluoride, abrasive, humectant, and detergent, and the contents of the secondary cartridge include at least flavorings and food colorings.

3. The device of claim 1, wherein the contents of each of the primary cartridge and the secondary cartridge are in the form of a gel.

4. The device of claim 1, wherein the contents of each of the primary cartridge and the secondary cartridge are in the form of a paste.

5. The device of claim 1, further including the dispenser operably connected with the housing in use.

6. The device of claim 1, wherein the primary cartridge and the secondary cartridge are sized to dispense through the nozzle no more than a predetermined volume of the components that equals a single use dollop of the personalized toothpaste.

7. The device of claim 1, wherein the device is configured, in cooperation with the dispenser, to dispense a predetermined single use dollop of the personalized toothpaste.

8. The device of claim 2, wherein the contents of the secondary cartridge are arranged in vertically ordered columns, each vertically ordered column including a different flavoring, and wherein each different flavoring has a different color.

9. The device of claim 1, wherein the housing includes a front side and a back side, and a mounting component positioned on the back side, wherein the mounting component is configured to attach to or hang from a mating mounting component that is fixed to a vertical surface, with the nozzle of the housing facing downward.

10. A system including the device of claim 1, the system further including the dispenser operably connected with the housing in use, and an external component connectable to the nozzle, and a connector fixedly positioned on the second end of the housing, wherein the external component includes a complementary connector configured to removably attach the external component to the housing via the connector and to be in fluid connection with the nozzle.

11. The system of claim 10, wherein the external component is an attachable adaptor configured to attach the nozzle to an open end of a toothpaste tube for dispensing the personalized toothpaste into the toothpaste tube in use.

12. The system of claim 10, wherein the dispenser includes a plunger insertable into the first end of the housing and alignable in fluid connection with each of the primary cartridge and the secondary cartridge, wherein in use, the personalized toothpaste is dispensed by a user applying a force on the plunger to move the components from each of the primary and the secondary cartridge into, through, and out of the nozzle.

13. The system of claim 10, wherein the dispenser includes a vacuum-operable dispenser including a second nozzle in fluid connection with an output end of the nozzle, wherein the vacuum-operable dispenser includes a vacuum extrusion pump that forms a vacuum seal at the exit end of the nozzle, a valve operable to release the vacuum seal, and a depressible tab operably connected to the valve, wherein in use, the personalized toothpaste is dispensed by a user pushing a toothbrush against the depressible tab thereby opening the valve and releasing the vacuum seal to move the components from each of the primary and the secondary cartridge into, through, and out of the nozzle and the second nozzle.

14. A kit for creating, storing, and dispensing a personalized toothpaste, comprising:

a device for blending and dispensing a personalized toothpaste, the device including:

a housing including a first end and a second end, and a first retaining chamber and a second retaining chamber parallel to the first retaining chamber and positioned perpendicularly between the first end and the second end, and wherein each of the first retaining chamber and the second retaining chamber is sized and shaped to receive therein and remove therefrom, respectively, a primary cartridge and a secondary cartridge, which are configured to be interchangeable with a different primary cartridge and a different secondary cartridge, respectively, wherein contents of each of the primary cartridge and the secondary cartridge and the different primary cartridge and the different secondary cartridge include components of a personalized toothpaste; and a nozzle extending from the second end of the housing and aligned in fluid connection with both the primary cartridge and the secondary cartridge to receive the components therefrom; and wherein the housing is operably connectable with a dispenser that is operable to move the components from each of the primary and the secondary cartridge into, through, and out of the nozzle to dispense the personalized toothpaste in use, wherein the personalized toothpaste exiting the nozzle is a blend of the components from the primary cartridge and the secondary cartridge; and wherein the first and the second retaining chamber of the device each include an alignment element positioned to receive the primary cartridge and the secondary cartridge in a predetermined rotational orientation, and each of the primary cartridge and the secondary cartridge includes a complementary alignment element that cooperates with the alignment element to seat each of the primary cartridge and the secondary cartridge in the predetermined rotational orientation:

the kit further including the primary cartridge filled with at least one or more of a fluoride, abrasive, humectant, and detergent; and at least one of the secondary cartridge and the different secondary cartridge, wherein the at least one of the secondary cartridge and the different secondary cartridge includes at least one of a flavoring and a food coloring.

15. The kit of claim 14, wherein the housing of the device includes a front side and a back side, and a mounting component positioned on the back side, wherein the mounting component is configured to attach to or hang from a complementary mounting component that is fixed to a vertical surface, with the nozzle of the housing facing downward, the kit further including a mounting assembly including the complementary mounting component.

16. The kit of claim 14, wherein the device further includes at least one external component connectable to the nozzle, and a connector fixedly positioned on the second end of the housing, wherein the at least one external component includes a complementary connector configured to removably attach the at least one external component to the housing via the connector and to be in fluid connection with the nozzle.

17. The kit of claim 16, further including at least one toothpaste tube, and wherein the at least one external component includes an attachable adaptor configured to attach the nozzle to an open end of the at least one toothpaste tube for dispensing the personalized toothpaste into the at least one toothpaste tube, the attachable adaptor including the complementary connector, a bore hole that fluidly connects the nozzle to an interior of the at least one toothpaste tube in use, and threads on an interior diameter for threadedly engaging the attachable adaptor to the toothpaste tube via its outer diameter, such that operation of the dispenser with the attachable adaptor positioned on the toothpaste tube and connected via the connector and the complementary connector to the housing dispenses the personalized toothpaste into the toothpaste tube.

18. The kit of claim 14, wherein the at least one of the secondary cartridge is a plurality of the secondary cartridges, each filled with a different flavoring.

19. The kit of claim 14, wherein each of the primary cartridge and the secondary cartridge includes a peel-off covering on at least one end of each of the primary cartridge and the secondary cartridge, the peel-off covering being removed in use.

20. The kit of claim 14, further including the dispenser, wherein the dispenser includes a plunger insertable into the first end of the housing and alignable in fluid connection with each of the primary cartridge and the secondary cartridge, wherein in use, the personalized toothpaste is dispensed by a user applying a force on the plunger to move the components from each of the primary and the secondary cartridge into, through, and out of the nozzle.

21. The kit of claim 14, further including the dispenser for operably connected with the housing in use, wherein the dispenser includes a vacuum-operable dispenser in fluid connection with an output end of the nozzle, wherein the vacuum-operable dispenser includes a vacuum chamber that forms a vacuum seal at the exit end of the nozzle, a valve operable to release the vacuum seal, and a depressible tab operably connected to the valve, wherein in use, the personalized toothpaste is dispensed by a user pushing a toothbrush against the depressible tab thereby opening the valve and releasing the vacuum seal to move the components from each of the primary and the secondary cartridge into, through, and out of the nozzle.

* * * * *